United States Patent [19]

Tervamäki

[11] 4,304,138

[45] Dec. 8, 1981

[54] MULTI-DOSE PIPETTE

[75] Inventor: Jukka Tervamäki, Helsinki, Finland

[73] Assignee: Kommandiittiyhtio Finnpipette Osmo A. Suovaniemi, Helsinki, Finland

[21] Appl. No.: 113,514

[22] Filed: Jan. 21, 1980

[30] Foreign Application Priority Data

Jan. 23, 1979 [FI] Finland ..... 790209

[51] Int. Cl.[3] ..... B01L 3/02

[52] U.S. Cl. ..... 73/864.17

[58] Field of Search ..... 73/425.4 P, 425.6; 422/100; 222/401

[56] References Cited

U.S. PATENT DOCUMENTS 4,096,751 6/1978 Withers et al. ..... 73/425.6

4,133,211 1/1979 Sarstedt ..... 73/425.6

FOREIGN PATENT DOCUMENTS 2525654 7/1976 Fed. Rep. of Germany .

*Primary Examiner*—S. Clement Swisher

*Attorney, Agent, or Firm*—Hopgood, Calimafde, Kalil, Blaustein & Judlowe

[57] ABSTRACT

A multi-dose pipette which comprises a body constituting the handle portion, a cylinder portion or piston chamber with a tip tube, fitted at the bottom end of the said body, a main piston fitted into the cylinder portion or piston chamber. The main piston can be pressed down by means of a press knob and a piston rod against the spring force of a spring and is by a spring returned to the upper position. In addition to the main piston, the pipette also comprises a dose piston with its piston chamber. The maximum stroke volume of the main piston is essentially larger than the stroke volume of the dose piston. The piston chamber of the main piston and the dose piston are connected to each other by means of a channel. The end of the piston chamber of the dose piston facing towards the piston rod is provided with a valve which is fitted so that it opens itself and admits air through the valve into the piston chamber at the upper position of the dose piston. The other end of the piston chamber of the dose piston is provided with a counter-valve which is fitted so that it opens itself and admits air through the valve from the piston chamber of the dose valve into the piston chamber of the main piston at the lower position of the dose piston. By means of repeated movements of the dose piston it is possible to pump precise doses of air into the piston chamber of the main piston. Correspondingly, subsequent liquid quantities of equal relative magnitude escape from the tip vessel.

6 Claims, 6 Drawing Figures

MULTI-DOSE PIPETTE

The subject of the present invention is a multi-dose pipette which comprises a body constituting the handle portion, a cylinder portion or piston chamber with a tip tube, fitted at the bottom end of the said body, a main piston fitted into the cylinder portion or piston chamber, which main piston can be pressed down by means of a press knob and a piston rod against the spring force of a spring and which main piston is by a spring returned to the upper position.

It is an objective of the invention to provide a multi-dose pipette by means of which it is possible to suck a large quantity of liquid, e.g. a reagent, into a disposable tip vessel and to dose the liquid rapidly and easily as smaller subsequent doses into test tubes.

Similar pipettes are previously known, but they are usually of a complicated construction and in many of them the dosage has been achieved by means of electronic control.

In the pipette subject of the present invention the dosage is produced mechanically by pumping air quantities of equal magnitude into the main piston chamber of the multi-dose pipette. The pumping movement can be performed either by pressing the same knob by which the liquid was sucked into the pipette but as different steps, or by means of an entirely different knob. Normal tip vessels which are commonly used in connection with pipettes fit to the multi-dose pipette in accordance with the invention.

The multi-dose pipette in accordance with the present invention is mainly characterized in that, in addition to the main piston, the pipette also comprises a dose piston with its piston chamber and that the maximum stroke volume of the main piston is essentially larger, for example 2 to 50 times as large, most appropriately 10 to 25 times as large, than the stroke volume of the dose piston and that the piston chambers of the main piston and the dose piston are connected to each other by means of a channel and that the end of the piston chamber of the dose piston facing towards the piston rod is provided with a valve which is fitted to that it opens itself and admits air through the valve into the piston chamber at the upper position of the dose piston, and the other end of the piston chamber of the dose piston is provided with a counter-valve which is fitted so that it opens itself and admits air through the valve from the piston chamber of the dose valve into the piston chamber of the main piston at the lower position of the dose piston, whereby by means of repeated movements of the dose piston it is possible to pump precise doses of air into the piston chamber of the main piston and whereby, correspondingly, subsequent liquid quantities of equal relative magnitude escape from the tip vessel.

Figure 1:
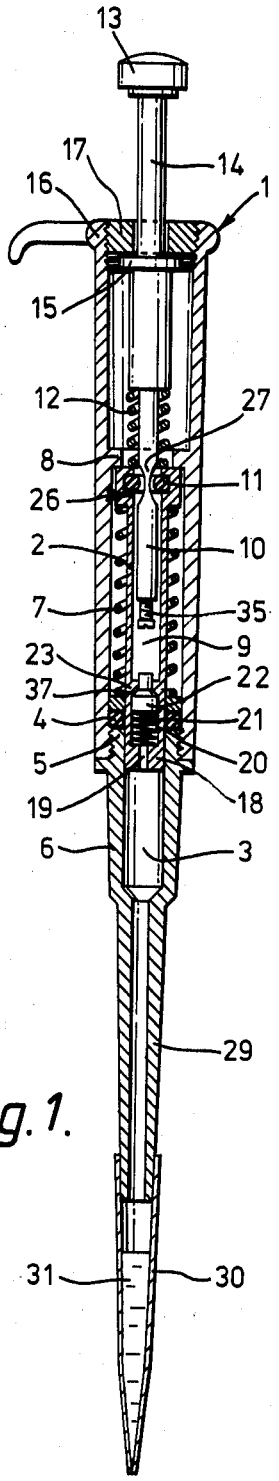
Figure 2:
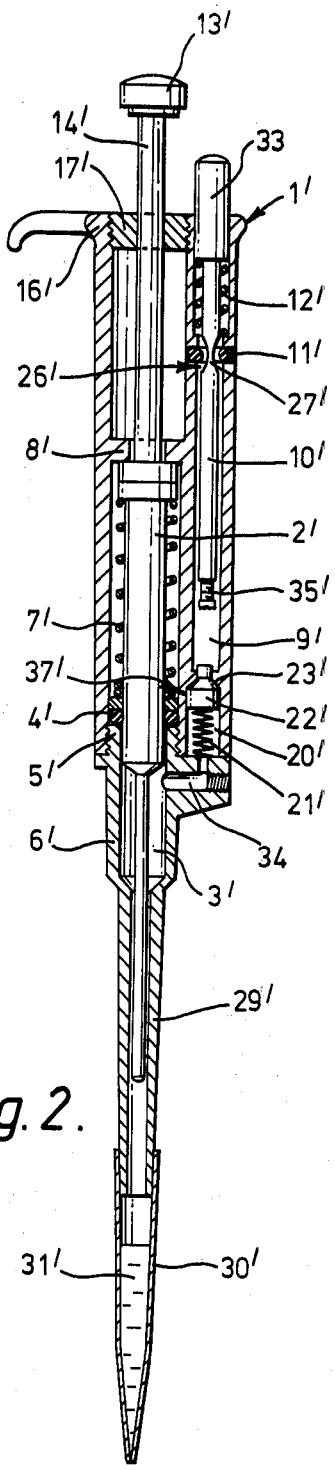
Figure 3:
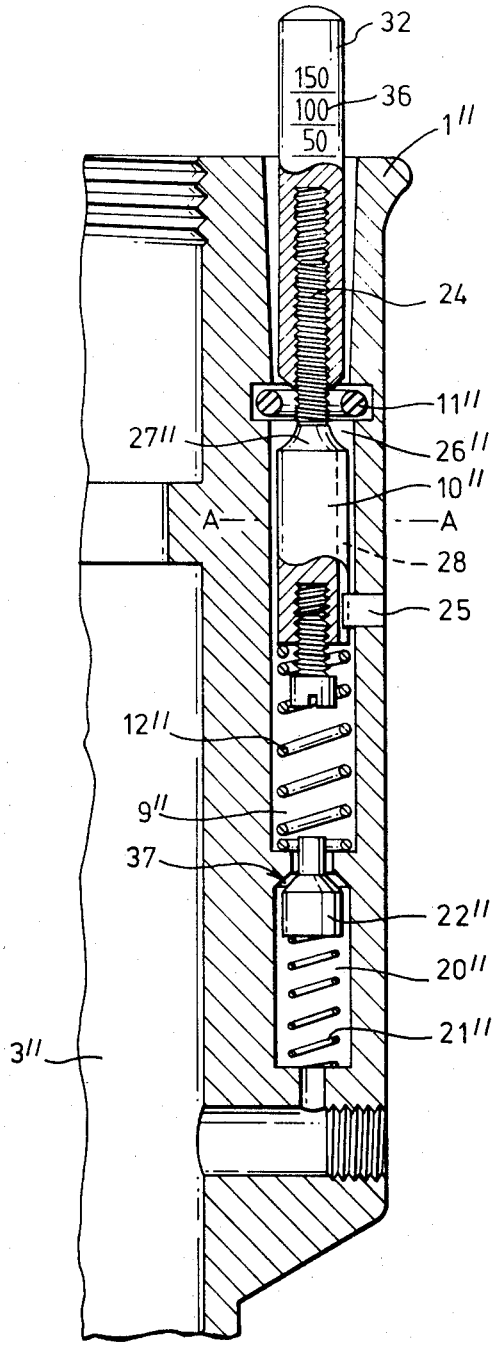
Figure 3:
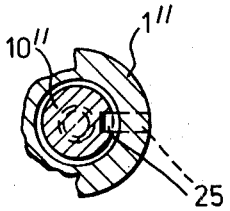
Figure 6:
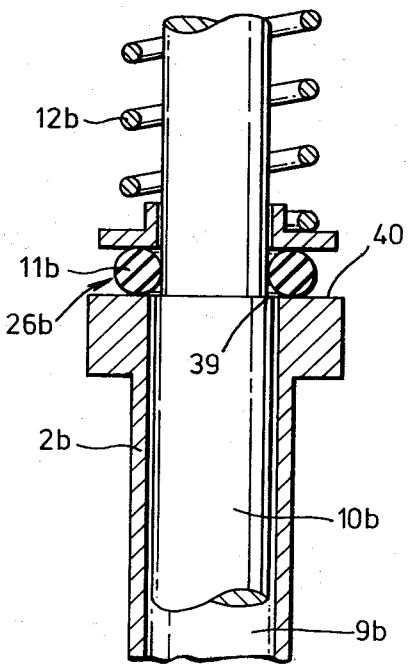
Figure 5:
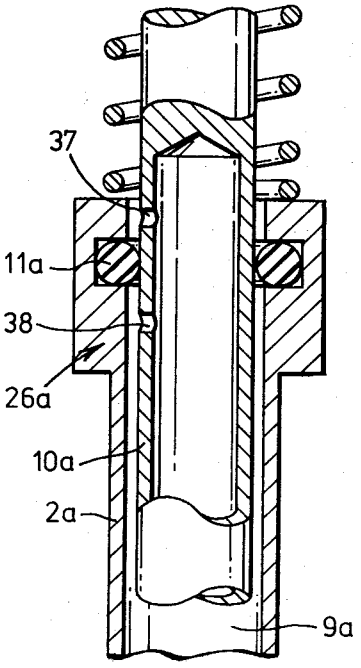
Figure 4:
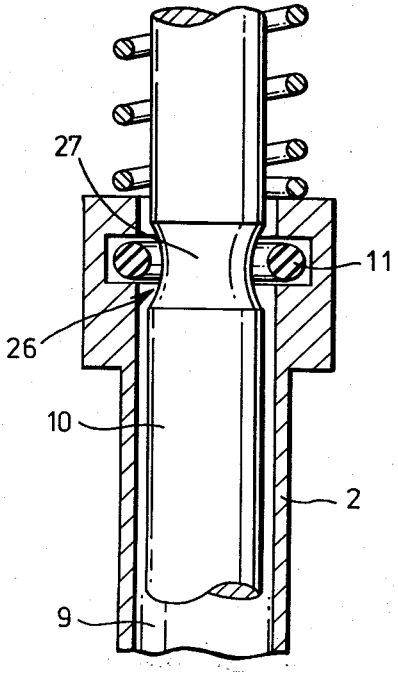

The invention comes out more closely from the following description and from the attached drawings, wherein FIG. 1 shows a multi-dose pipette in accordance with the invention as a side view in section, FIG. 2 shows an embodiment alternative to the multi-dose pipette shown in FIG. 1, FIG. 3 shows an arrangement by which the dose quantity of the pipette shown in FIG. 2 can be made adjustable, FIG. 4 is an enlarged view of the valve construction above the piston chamber of the dose piston in the multi-dose pipette shown in FIG. 1, and FIGS. 5 and 6 show embodiments alternative to the valve construction shown in FIG. 4.

In FIG. 1 the pipette 1 is provided with a main piston 2 in the piston chamber 3, sealed by the O-ring 4 against the mouth 5 of the chamber, which mouth consists of the sleeve-shaped tip portion 6 of the pipette. The spring 7 presses the piston 2 upwards towards the upper stop 8. In the chamber 9 formed inside the hollow main piston 2 the dose piston 10 is placed, which is by means of an O-ring 11 sealed at the mouth of the main piston 2 and which dose piston 10 is pushed upwards by the spring 12. The dose piston 10 is fastened to the shaft 14 of the knob 13, which shaft is provided with a shoulder 15 which operates as the stop of the spring 12 and limits the movement of the knob shaft 14 upwards when the shoulder 15 meets the stop 17 on the handle 16 of the pipette 1. At the bottom end 18 of the main piston 2 there is an air hole 19 passing into the chamber 9.

Further, the bottom end 18 of the main piston 2 defines a valve casing 20 inside the main piston 2, the spring 21 in the valve casing 20 pressing the valve 37 blocking means 22 against the shoulder 23. The blocking means 22 may be a ball or a corresponding means, but the essential feature is that, when the dose piston 10 moves down when the knob 13 is pressed, the bottom end of the dose piston 10 can open the valve 37. The upper end of the blocking means 22 can, e.g., extend up to above the shoulder 23, like in FIG. 1, or the end of the piston 10 is provided with a narrowed-off section which may penetrate inside the shoulder 23. When the dose piston 10 moves upwards, the valve 26 in the upper part of the main piston 2 is opened. This valve 26 may consist of a narrowed-off section 27 on the dose piston 10 (FIG. 4), which admits air into the main piston 2 when the narrowed-off section 27 by-passes the O-ring 11 while the dose piston 10 moves upwards. Thus, the valve in FIG. 4 operates so that the narrowed-off section 27 in the dose piston 10 admits air past the seal 11 into the dose piston chamber 9. When the dose piston 10 starts being pushed down from this upper position, the edge of the narrowed-off section 27 is pressed against the seal 11 and the piston chamber 9 is closed.

The same function has been achieved in the embodiment shown in FIG. 5 by designing the dose piston 10*a* as a hollow tube into which holes 37 and 38 have been drilled. At the initial position of the dose piston 10*a* air has access through the hole 37 into the dose piston 10*a* and from there through the hole 38 into the chamber 9*a*, which is closed when the hole 37 passes beyond the seal 11*a* while the dose piston 10*a* is being pressed down.

The valve embodiment shown in FIG. 6 operates so that the dose piston 10*b* is provided with a shoulder 39, which raises the seal 11*b* somewhat loose from its counter-face 40 when the dose piston 10*b* goes up. When the dose piston 10*b* moves down, the spring 12*b* presses the seal 11*b* against the counter-face 40, whereby the piston chamber 9*b* is closed.

The pipette 1 shown in FIG. 1 operates so that, when the knob 13 is pressed down to the bottom, both the main piston 2 and the dose piston 10 push the quantity of air required by their movement out of the disposable tip vessel 30 placed at the mouth of the tip tube 29 of the pipette. When the disposable tip 30 is now placed into liquid and the knob 13 is allowed to glide upwards, the main piston 2 sucks liquid 31 into the tip vessel 30 until the main piston has reached its upper stop 8.

Hereupon the dose piston 10 starts moving upwards, whereby initially the valve 37 at the bottom part of the main piston 2 is closed immediately, whereby liquid is no longer sucked into the tip vessel 30. On the contrary, the upwards movement of the dose piston 10 produces a vacuum in the chamber 9 until the dose piston 10 reaches its upper position, whereby the valve 26 at the upper end of the main piston 2 is opened and admits air and levels out the pressure in the chamber 9.

After the tip vessel 30 has been removed from the liquid and placed to the desired vessel, e.g. to the mouth of a test tube, the dosage of liquid 31 can be started by pressing the knob 13 by subsequent movements only the distance of the movement of the dose piston 10. When the dose piston 10 starts moving downwards, the valve 26 at the upper end of the main piston 2 is first blocked. Thereupon the dose piston 10 starts compressing the air in the chamber 9, in which the pressure is increased. When the pressure reaches a certain value, it (the pressure) opens the valve at the bottom end of the main piston 2 and air starts flowing into the main piston chamber 3 through the hole 19. If the spring 21 is sufficiently strong, the valve 37 is not opened by the pressure but by the dose piston 10 when the piston reaches its lower position and presses the valve 37 open.

When the quantity of air displaced by the dose piston 10 arrives in the main piston chamber 9, it pushes the corresponding quantity of liquid 31 from the tip vessel 30. The ratios of the air volumes displaced by the main piston 2 and the dose piston 10 may be, e.g., 1:10 or 1:50 or any other ratio, whereby it is possible, by means of repeated movements of the dose piston, to produce a number of doses corresponding this ratio (10 or 50).

Thus, in practice the dose piston 10 is an air pump that pushes air doses into the main piston chamber.

For the purpose of calibration of the magnitude of the doses, the bottom end of the dose piston may be provided with an adjusting screw 35. By turning the screw 35 outwards from the dose piston 10, the screw 35 opens the valve earlier, whereby the dose becomes smaller. In the contrary case, when the screw 35 is turned inwards, the dose becomes larger.

A multi-dose pipette may also be accomplished in the way shown in FIG. 2 so that the dose piston 10' is positioned at the side of the main piston 2'. Then the movement of the knob 13' can be made shorter, which may be desirable for some operators. In such a case the dose piston 10' has a knob 33 of its own as well as a piston chamber 9' of its own, separate from the main piston 2', whose both ends are provided with valves 37' and 26'. An air tube 34 passes from the valve casing 20' to the main piston chamber 3'.

The liquid 31' is sucked into the tip vessel 30' by pressing the knob 13', and it is dosed by means of the knob 33. In other respects the operation of the pipette 1' is completely similar to that described above. In the embodiment of FIG. 2 the components corresponding those in FIG. 1 have been denoted with the same reference numerals as provided with apostrophe.

It is also possible to make both the liquid quantity to be taken into the tip vessel and the liquid quantity to be dosed from same adjustable. The liquid quantity to be taken in can be adjusted, e.g., in accordance with the principle disclosed in the Finnish Patent Application No. 781764, "Pipette with adjustable volume", in which case the stroke length of the main piston would be adjustable. The principle of adjustment of the dose quantity is presented in FIG. 3. There the narrowed-off section 27'' forming the valve 26'' at the upper end of the dose piston 10'' has been designed so that its length can be adjusted by means of a screw 24. When the knob 32 is turned upwards, the valve 26'' is closed later when the knob 32 is pressed, and the dose becomes smaller. The pin 25 in the groove 28 of the dose piston 10'' prevents the dose piston 10'' from rotating when the knob 32 is turned for the purpose of adjusting the dose quantity. At the side of the knob 32 there may be an adjusting scale 36 indicating the dose quantity.

Of course, the air-pump principle can also be accomplished in many other ways especially in respect of details of the valves with the principle of operation of the multi-dose pipette remaining unchanged.

What we claim is:

1. An improved multi-dose pipette of the type having a body including a handle portion, a main cylinder portion, a tip tube fitted to the lower end of said body, a main piston slidably fitted within said main cylinder, a piston rod joined to said main piston, knob means coupled to said piston rod for effecting movement of said main piston, biasing means for returning said main piston to an upper position, the improvement comprising:

a dose piston slidably fitted within a dose cylinder and displaceable from an upper to a lower position, said dose piston and said dose cylinder being separate from said main piston and said main cylinder, the maximum stroke volume of said main piston being 2 to 50 times as large as that of said dose piston, channel means connecting said main and said dose cylinders, a piston rod connected to the upper portion of said dose piston, a valve located at the upper portion of said dose cylinder, said valve being constructed and arranged to admit air to said dose cylinder when said dose piston is at its upper position, said valve not admitting air to said dose cylinder when said dose piston is at position other than said upper position, said channel means having a counter-valve constructed and arranged so that it opens and admits air from the dose cylinder into the main cylinder when said dose piston is at its lower position whereby by repeated movement of said dose piston precise doses of air are pumped into the main cylinder and corresponding liquid quantities of equal relative magnitude are discharged from said tip tube.

2. The multi-dose pipette as claimed in claim 1, wherein the lower end of said dose piston includes a calibration screw.

3. The multi-dose pipette as claimed in claim 1, wherein said valve located at the upper portion of said dose cylinder includes a transverse ring groove formed in the upper part of said dose cylinder, an O-ring seal fitted within said transverse ring groove and surrounding said piston rod of said dose piston, said piston rod of said dose cylinder including a narrowed section, said narrowed section being narrower than the inner diameter of said O-ring seal, said O-ring seal and said narrowed section of said piston rod being at the same level when said dose piston is at its upper position to thereby permit the inflow of air.

4. The multi-dose pipette as claimed in claim 3, wherein said narrowed section of said piston rod of said dose piston includes first and second parts, said first and second parts being threaded together to thereby permit the adjustment of the length of said narrowed section so that the dosage volume may be adjusted by turning said first and second parts with respect to each other.

5. The multi-dose pipette as claimed in claim 1, wherein said valve located at the upper portion of said dose cylinder includes an O-ring seal fitted into a transverse groove formed in the upper portion of said dose cylinder, said piston rod of said dose cylinder including a hollow portion, first and second apertures at each end of said hollow portion connecting said hollow portion to the exterior of said piston rod, said first and second apertures being located on opposite sides of said O-ring seal when said dose piston is at its upper position to thereby permit air to flow within the hollow portion of said piston from one side of said O-ring seal to the other.

6. The multi-dose pipette as claimed in claim 1, wherein said valve located at the upper portion of said dose cylinder, includes a counter-face at the upper portion of said dose cylinder, an O-ring seal surrounding said piston rod of said dose piston and contacting said counter-face, said piston rod of said dose piston including means for moving said O-ring seal from its contact with said counter-face to permit air to flow into said dose cylinder.

* * * * *